US008602106B2

(12) United States Patent
Lopez

(10) Patent No.: US 8,602,106 B2
(45) Date of Patent: Dec. 10, 2013

(54) DOWNHOLE FLUID FLOW CONTROL SYSTEM AND METHOD HAVING DIRECTION DEPENDENT FLOW RESISTANCE

(75) Inventor: Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 12/966,772

(22) Filed: Dec. 13, 2010

(65) Prior Publication Data

US 2012/0145385 A1 Jun. 14, 2012

(51) Int. Cl.
*E21B 33/00* (2006.01)

(52) U.S. Cl.
USPC ..... 166/319; 166/316

(58) Field of Classification Search
USPC ..... 166/316, 319, 52, 272.3, 268, 229, 236, 166/235; 137/806, 812, 825, 813
See application file for complete search history.

(56) References Cited

U.S. PATENT DOCUMENTS

| | | | | |
|---|---|---|---|---|
| 3,566,900 | A | 3/1971 | Black | |
| 3,586,104 | A | 6/1971 | Hyde | |
| 3,620,238 | A | 11/1971 | Kawabata | |
| 3,712,321 | A | 1/1973 | Bauer | |
| 3,850,190 | A | 11/1974 | Carlson | |
| 4,276,943 | A | 7/1981 | Holmes | |
| 4,364,232 | A | 12/1982 | Sheinbaum | |
| 4,418,721 | A | 12/1983 | Holmes | |
| 4,434,054 | A * | 2/1984 | Livesey et al. | 210/484 |
| 4,557,295 | A | 12/1985 | Holmes | |
| 4,648,455 | A | 3/1987 | Luke | |
| 4,664,186 | A * | 5/1987 | Roeder | 166/68.5 |
| 4,895,582 | A | 1/1990 | Bielefeldt | |
| 5,076,327 | A | 12/1991 | Mettner | |
| 5,338,496 | A | 8/1994 | Talbot et al. | |
| 5,707,214 | A | 1/1998 | Schmidt | |
| 6,497,252 | B1 | 12/2002 | Kohler et al. | |
| 6,708,763 | B2 | 3/2004 | Howard et al. | |
| 6,769,498 | B2 | 8/2004 | Hughes | |
| 7,350,577 | B2 | 4/2008 | Howard et al. | |
| 7,464,609 | B2 | 12/2008 | Fallet | |

(Continued)

FOREIGN PATENT DOCUMENTS

WO 2011041674 4/2011

OTHER PUBLICATIONS

International Search Report and Written Opinion, PCT/US2011/062190, KIPO (Jul. 30, 2012).

(Continued)

*Primary Examiner* — Kenneth L Thompson
*Assistant Examiner* — Ronald Runyan
(74) *Attorney, Agent, or Firm* — Lawrence R. Youst

(57) ABSTRACT

A downhole fluid flow control system (100). The flow control system (100) includes a flow control component (122) having direction dependent flow resistance created by a vortex chamber (144). Production fluids (140) that travel through the flow control component (122) in a first direction enter the vortex chamber (144) traveling primarily in a tangential direction (148) to experience a first pressure drop. Injection fluids (150) that travel through the flow control component (122) in a second direction enter the vortex chamber (144) traveling primarily in a radial direction (152) to experience a second pressure drop. The pressure drop created by the tangential flow (148) of the production fluids (140) is greater than the pressure drop created by the radial flow (152) of the injection fluids (150).

8 Claims, 6 Drawing Sheets

(56) References Cited

U.S. PATENT DOCUMENTS

| | | | | |
|---|---|---|---|---|
| 8,261,839 | B2 * | 9/2012 | Fripp et al. | 166/373 |
| 2003/0173086 | A1 | 9/2003 | Howard et al. | |
| 2004/0011561 | A1 | 1/2004 | Hughes | |
| 2005/0150657 | A1 | 7/2005 | Howard et al. | |
| 2007/0169942 | A1 | 7/2007 | Loretz et al. | |
| 2007/0193752 | A1 | 8/2007 | Kim | |
| 2008/0314578 | A1 | 12/2008 | Jackson | |
| 2009/0078428 | A1 * | 3/2009 | Ali | 166/373 |
| 2009/0205834 | A1 | 8/2009 | Garcia et al. | |
| 2011/0139453 | A1 | 6/2011 | Schultz et al. | |
| 2011/0308806 | A9 * | 12/2011 | Dykstra et al. | 166/316 |

OTHER PUBLICATIONS

Stanley W. Angrist, "Fluid Control Devices." Scientific American, Dec. 1964: pp. 80-88.

Rune Freyer, et al. "An Oil Selective Inflow Control System." SPE 78272, Oct. 29-31, 2002. pp. 1-8.

"Lee Restrictor Selector" The Lee Company, (Undated but admitted prior art).

* cited by examiner

DOWNHOLE FLUID FLOW CONTROL SYSTEM AND METHOD HAVING DIRECTION DEPENDENT FLOW RESISTANCE

TECHNICAL FIELD OF THE INVENTION

This invention relates, in general, to equipment utilized in conjunction with operations performed in subterranean wells and, in particular, to a downhole fluid flow control system and method that are operable to control the inflow of formation fluids and the outflow of injection fluids with direction dependent flow resistance.

BACKGROUND OF THE INVENTION

Without limiting the scope of the present invention, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flow of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow control components such as flow tubes, nozzles, labyrinths or the like. Typically, the production flowrate through these flow control screens is fixed prior to installation by the number and design of the flow control components.

It has been found that certain completions utilizing such flow control screens may benefit from a stimulation treatment prior to production. For example, in one type of stimulation treatment, a fluid containing a reactive acid, such as hydrochloric acid, may be injected into the reservoir formation. Such acid stimulation treatments are designed to improve the formation permeability which enhances production of reservoir fluids. Typically, acid stimulation treatments are performed by injecting the treatment fluid at a high flowrate and at a treatment pressure near but below the fracture pressure of the formation. This type of protocol enables the acid to penetrate the formation but avoids causing damage to the reservoir formation.

It has been found, however, that achieving the desired injection flowrate and pressure profile by reverse flow through conventional flow control screens is impracticable. As the flow control components are designed for production flowrates, attempting to reverse flow through conventional flow control components at injection flowrates causes an unacceptable pressure drop. In addition, it has been found that the high velocity of the injection fluids through conventional flow control components may result in erosion within the flow control components. Further, it has been found that achieving the desired injection pressure may require exceeding the pressure rating of conventional flow control components during the treatment operation.

Accordingly, a need has arisen for a flow control screen that is operable to control the inflow of formation fluids in a completion requiring sand control. A need has also arisen for such a flow control screen that is operable to allow reverse flow from the completion string into the formation at the desired injection flowrate without creating an unacceptable pressure drop. Further, need has also arisen for such a flow control screen that is operable to allow reverse flow from the completion string into the formation at the desired injection flowrate without causing erosion within the flow control components and without exceeding the pressure rating of the flow control components during the treatment operation.

SUMMARY OF THE INVENTION

The present invention disclosed herein comprises a downhole fluid flow control system for controlling the inflow of formation fluids which may be used in completions requiring sand control. In addition, the downhole fluid flow control system of the present invention is operable to allow reverse flow from the completion string into the formation at a desired injection rate without creating an unacceptable pressure drop, without causing erosion within the flow control components and without exceeding the pressure rating of the flow control components during the treatment operation.

In one aspect, the present invention is directed to a downhole fluid flow control system. The downhole fluid flow control system includes a flow control component having direction dependent flow resistance such that production fluid flow traveling through the flow control component in a first direction experiences a first pressure drop and injection fluid flow traveling through the flow control component in a second direction experiences a second pressure drop, the first pressure drop being different from the second pressure drop.

In one embodiment, the flow control component includes an outer flow control element, an inner flow control element and a nozzle element. In certain embodiments, the flow control component includes a vortex chamber which may be formed between the outer flow control element and the inner flow control element. In these embodiments, production fluid flow entering the vortex chamber travels primarily in a tangential direction while injection fluid flow entering the vortex chamber travels primarily in a radial direction such that the first pressure drop is greater than the second pressure drop.

In another aspect, the present invention is directed to a flow control screen. The flow control screen includes a base pipe with an internal passageway, a blank pipe section and a perforated section. A filter medium is positioned around the blank pipe section of the base pipe. A housing is positioned around the base pipe defining a fluid flow path between the filter medium and the internal passageway. At least one flow control component is disposed within the fluid flow path. The at least one flow control component has direction dependent flow resistance such that production fluid flow in the fluid flow path traveling from the filter medium to the internal passageway experiences a first pressure drop and injection fluid flow in the fluid flow path traveling from the internal passageway to the filter medium experiences a second pressure drop, wherein the first pressure drop is different from the second pressure drop.

In a further aspect, the present invention is directed to a flow control screen. The flow control screen includes a base pipe with an internal passageway, a blank pipe section and a perforated section. A filter medium is positioned around the blank pipe section of the base pipe. A housing positioned around the base pipe defines a fluid flow path between the filter medium and the internal passageway. A flow control section is positioned around the perforated section of the base pipe. The flow control section includes a plurality of flow control components having direction dependent flow resistance such that production fluid flow traveling from the filter medium to the internal passageway experiences a first pressure drop and injection fluid flow traveling from the internal passageway to the filter medium experiences a second pressure drop, the first pressure drop being different from the second pressure drop.

In yet another aspect, the present invention is directed to a downhole fluid flow control method. The method includes positioning a fluid flow control system having a flow control component with direction dependent flow resistance at a target location downhole, pumping a treatment fluid from the surface into a formation through the flow control component in a first direction such that the treatment fluid experiences a first pressure drop and producing a formation fluid to the surface through the flow control component in a second direction such that the formation fluid experiences a second pressure drop, wherein the first pressure drop is different from the second pressure drop.

The method may also include positioning a fluid flow control system having a flow control component with a vortex chamber at the target location downhole, pumping the treatment fluid into the vortex chamber such that the treatment fluid entering the vortex chamber travels primarily in a radial direction and producing the formation fluid into the vortex chamber such that the formation fluid entering the vortex chamber travels primarily in a tangential direction.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
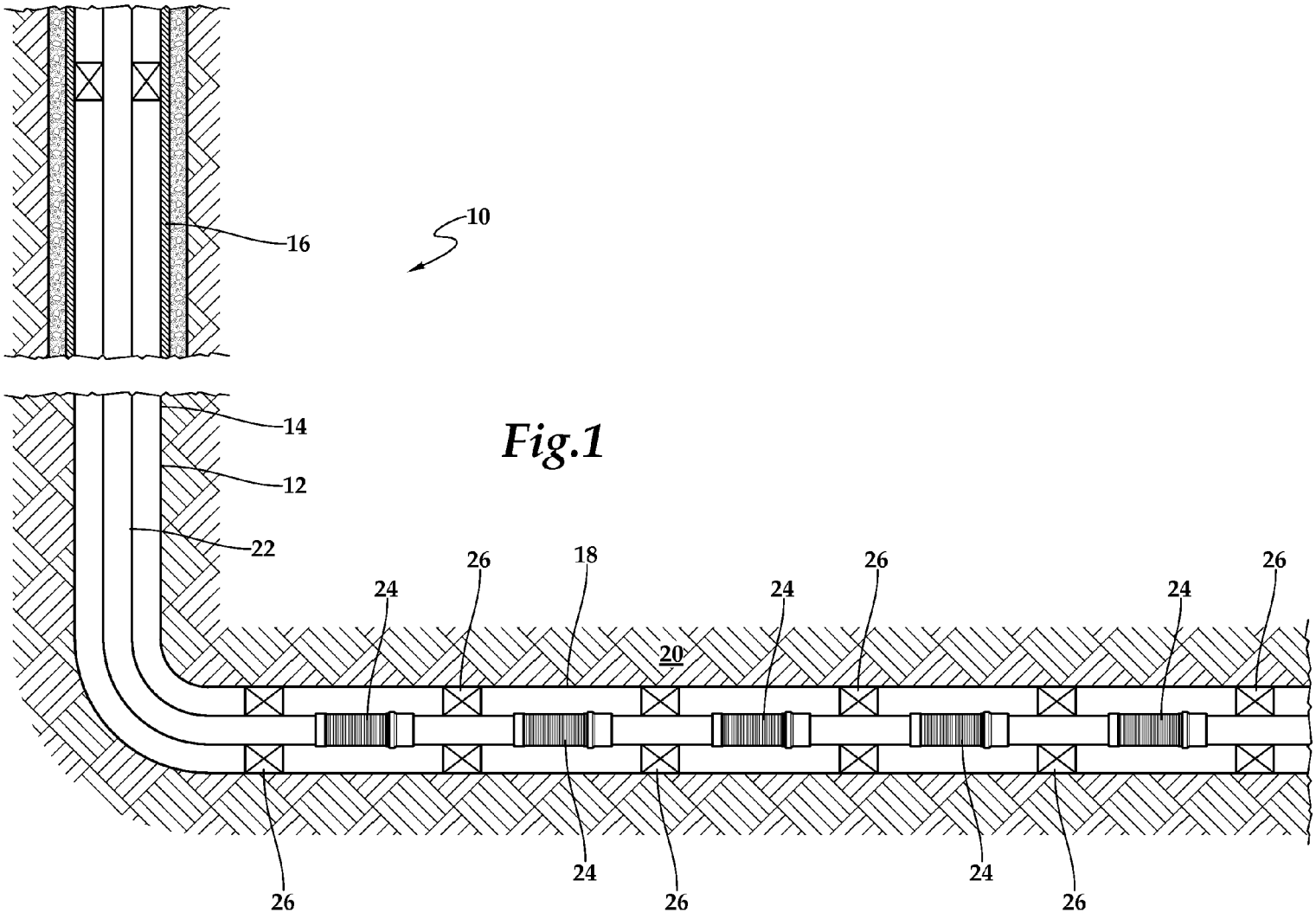
FIG. 1 is a schematic illustration of a well system operating a plurality of downhole fluid flow control systems according to an embodiment of the present invention.

Referring initially to FIG. 1, therein is depicted a well system including a plurality of downhole fluid flow control systems embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. At its lower end, tubing string 22 is coupled to a completions string that has been installed in wellbore 12 and divides the completion interval into various production intervals adjacent to formation 20. The completion string includes a plurality of fluid flow control systems 24, each of which is positioned between a pair of packers 26 that provides a fluid seal between the completion string 22 and wellbore 12, thereby defining the production intervals. In the illustrated embodiment, fluid flow control systems 24 serve the function of filtering particulate matter out of the production fluid stream. Each fluid flow control system 24 has a flow control section that is operable to control the flow of a production fluid stream during the production phase of well operations and is also operable to control the flow of an injection fluid stream during a treatment phase of well operations. As explained in greater detail below, the flow control sections create a flow restriction on the fluid passing therethrough. Preferably, the restriction created on production fluid flow through the flow control sections is greater than the restriction created on injection fluid flow. In other words, fluid flow in the production direction will experience a greater pressure drop than fluid flow in the injection direction through the flow control sections of fluid flow control systems 24.

Even though FIG. 1 depicts the fluid flow control systems of the present invention in an open hole environment, it should be understood by those skilled in the art that the present invention is equally well suited for use in cased wells. Also, even though FIG. 1 depicts one fluid flow control system in each production interval, it should be understood by those skilled in the art that any number of fluid flow control systems of the present invention may be deployed within a production interval without departing from the principles of the present invention. In addition, even though FIG. 1 depicts the fluid flow control systems of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
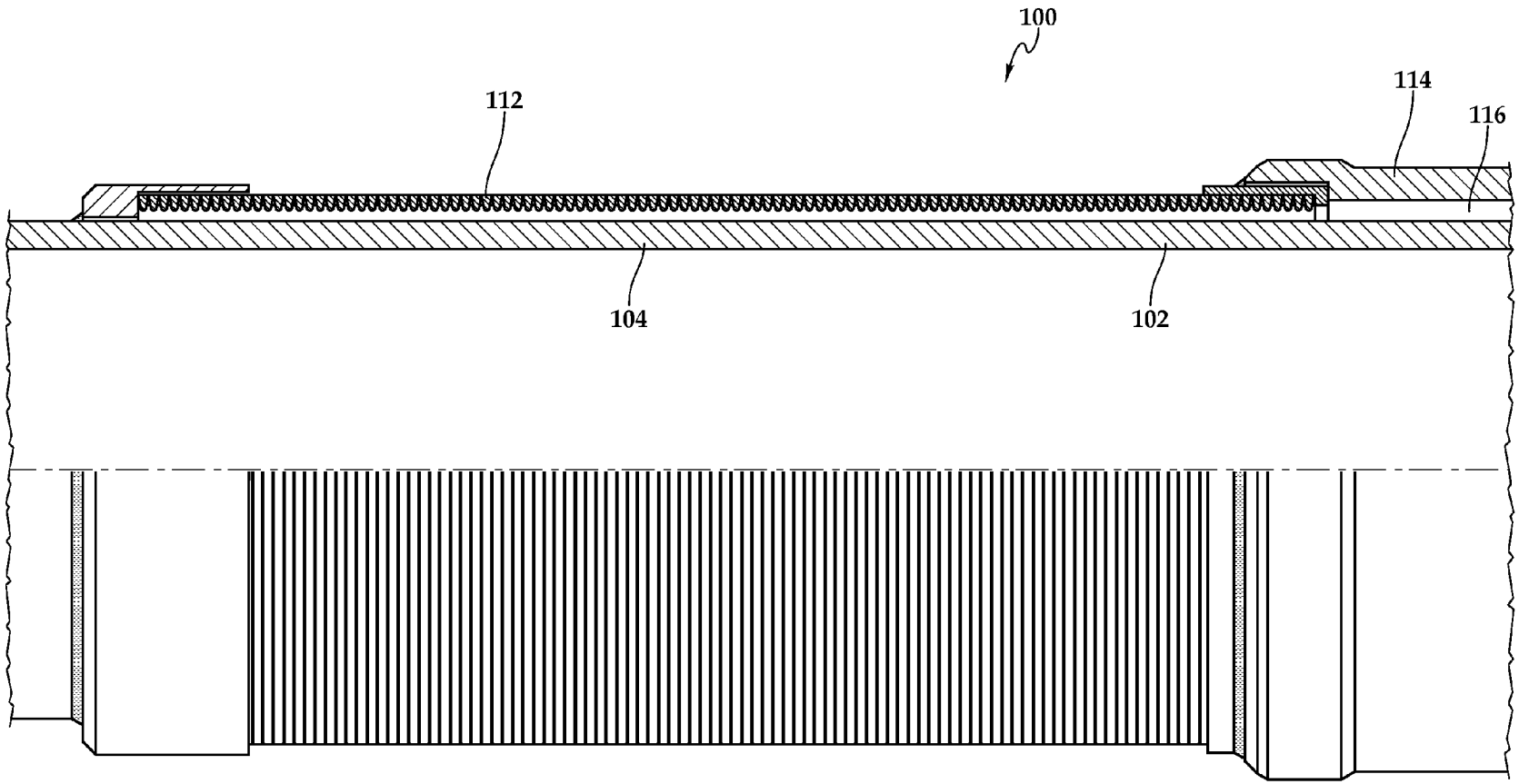
FIGS. 2A-2B are quarter sectional views of successive axial sections of a downhole fluid flow control system embodied in a flow control screen of the present invention.
Figure 2B:
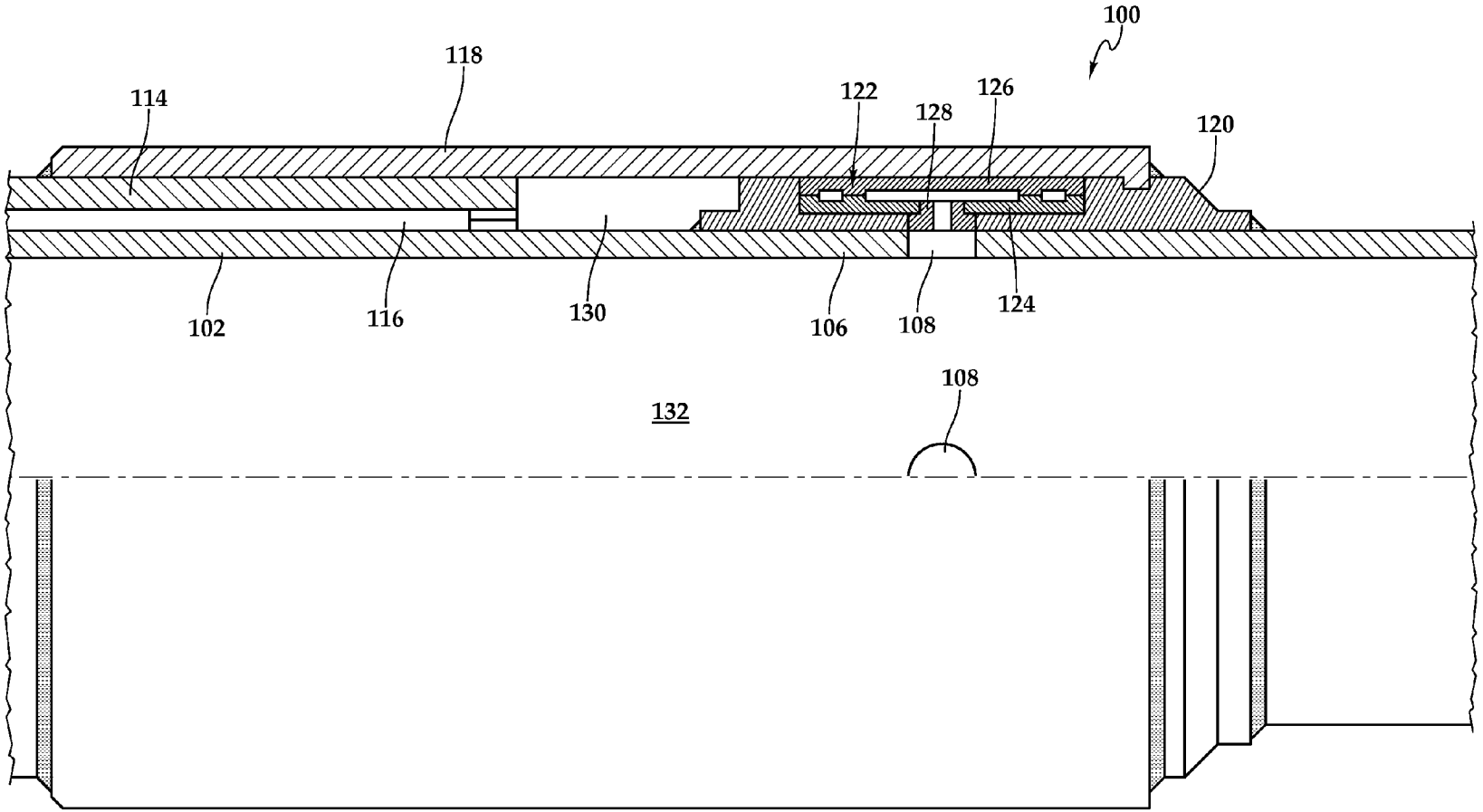

Referring next to FIGS. 2A-2B, therein is depicted successive axial sections of a fluid flow control system according to the present invention that is representatively illustrated and generally designated 100. Fluid flow control system 100 may be suitably coupled to other similar fluid flow control systems, production packers, locating nipples, production tubulars or other downhole tools to form a completions string as described above. Fluid flow control system 100 includes a base pipe 102 that has a blank pipe section 104 and a perforated section 106 including a plurality of production ports 108. Positioned around an uphole portion of blank pipe section 104 is a screen element or filter medium 112, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium associated with fluid flow control system 100 is not critical to the present invention.

Positioned downhole of filter medium 112 is a screen interface housing 114 that forms an annulus 116 with base pipe 102. Securably connected to the downhole end of screen interface housing 114 is a flow control housing 118. At its downhole end, flow control housing 118 is securably connected to a support assembly 120 which is securably coupled to base pipe 102. The various connections of the components of fluid flow control system 100 may be made in any suitable fashion including welding, threading and the like as well as through the use of fasteners such as pins, set screws and the like. Positioned between support assembly 120 and flow control housing 118 are a plurality of flow control components 122, only one of which is visible in FIG. 2B. In the illustrated embodiment, flow control components 122 are circumferentially distributed about base pipe 102 at ninety degree intervals such that four flow control components 122 are provided. Even though a particular arrangement of flow control components 122 has been described and depicted, it should be understood by those skilled in the art that other numbers and arrangements of flow control components 122 may be used. For example, either a greater or lesser number of circumferentially distributed flow control components at uniform or nonuniform intervals may be used. Additionally or alternatively, flow control components 122 may be longitudinally distributed along base pipe 102.

In the illustrated embodiment, each flow control component 122 is formed from an inner flow control element 124, an outer flow control element 126 and a nozzle element 128 which is positioned in the center of each flow control component 122 and is aligned with one of the opening 108. Even though a three part flow control component has been depicted and described, those skilled in the art will recognize that a flow control component of the present invention could be formed from a different number of elements both less than or greater than three including a single element design.

As discussed in greater detail below, flow control components 122 are operable to control the flow of fluid in either direction therethrough. For example, during the production phase of well operations, fluid flows from the formation into the production tubing through fluid flow control system 100. The production fluid, after being filtered by filter medium 112, if present, flows into annulus 116. The fluid then travels into an annular region 130 between base pipe 102 and flow control housing 118 before entering the flow control section as further described below. The fluid then enters one or more inlets of flow control components 122 where the desired flow resistance is applied to the fluid flow achieving the desired pressure drop. Thereafter, the fluid is discharged through nozzle 128 via opening 108 to the interior flow path 132 of base pipe 102 for production to the surface.

During the treatment phase of well operations, a treatment fluid may be pumped downhole from the surface in the interior flow path 132 of base pipe 102. The treatment fluid then enters the flow control components 122 through openings 108 via nozzles 128 where the desired flow resistance is applied to the fluid flow achieving the desired pressure drop. The fluid then travels into annular region 130 between base pipe 102 and flow control housing 118 before entering annulus 116 and passing through filter medium 112 for injection into the surrounding formation.

Figure 3:
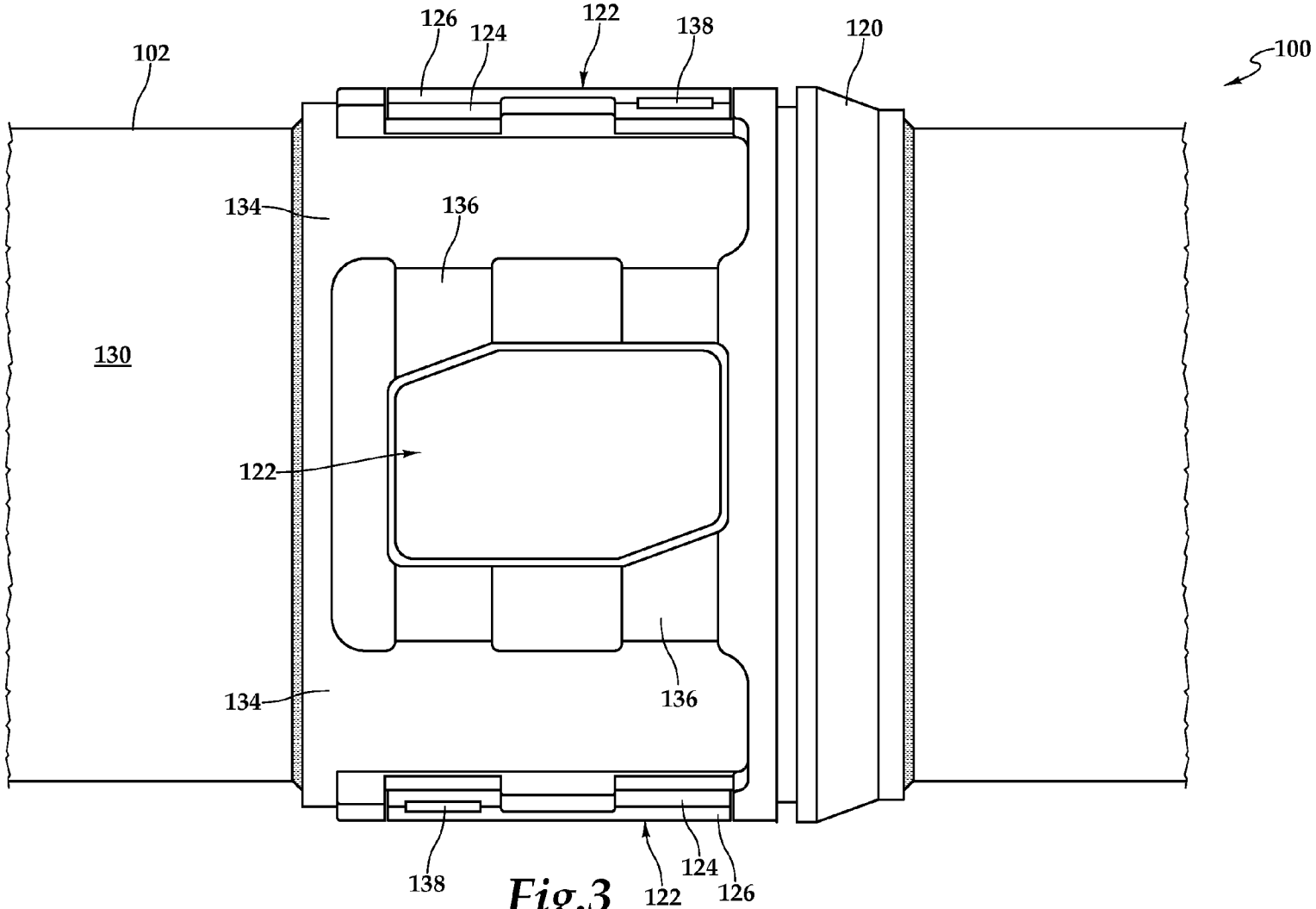
FIG. 3 is a top view of the flow control section of a downhole fluid flow control system according to an embodiment of the present invention with the outer housing removed.

Referring next to FIG. 3, a flow control section of fluid flow control system 100 is representatively illustrated. In the illustrated section, a support assembly 120 is securably coupled to base pipe 102. Support assembly 120 is operable to receive and support four flow control components 122. The illustrated flow control components 122 are each formed from an inner flow control element 124, an outer flow control element 126 and a nozzle element 128 (see FIG. 2B). Support assembly 120 is positioned about base pipe 102 such that the nozzle elements will be circumferentially and longitudinally aligned with the openings 108 (see FIG. 2B) of base pipe 102. Support assembly 120 includes a plurality of channels for directing fluid flow between flow control components 122 and annular region 130. Specifically, support assembly 120 includes a plurality of longitudinal channels 134 and a plurality of circumferential channels 136. Together, longitudinal channels 134 and circumferential channels 136 provide a pathway for fluid flow between openings 138 of flow control components 122 and annular region 130.

Figure 4:
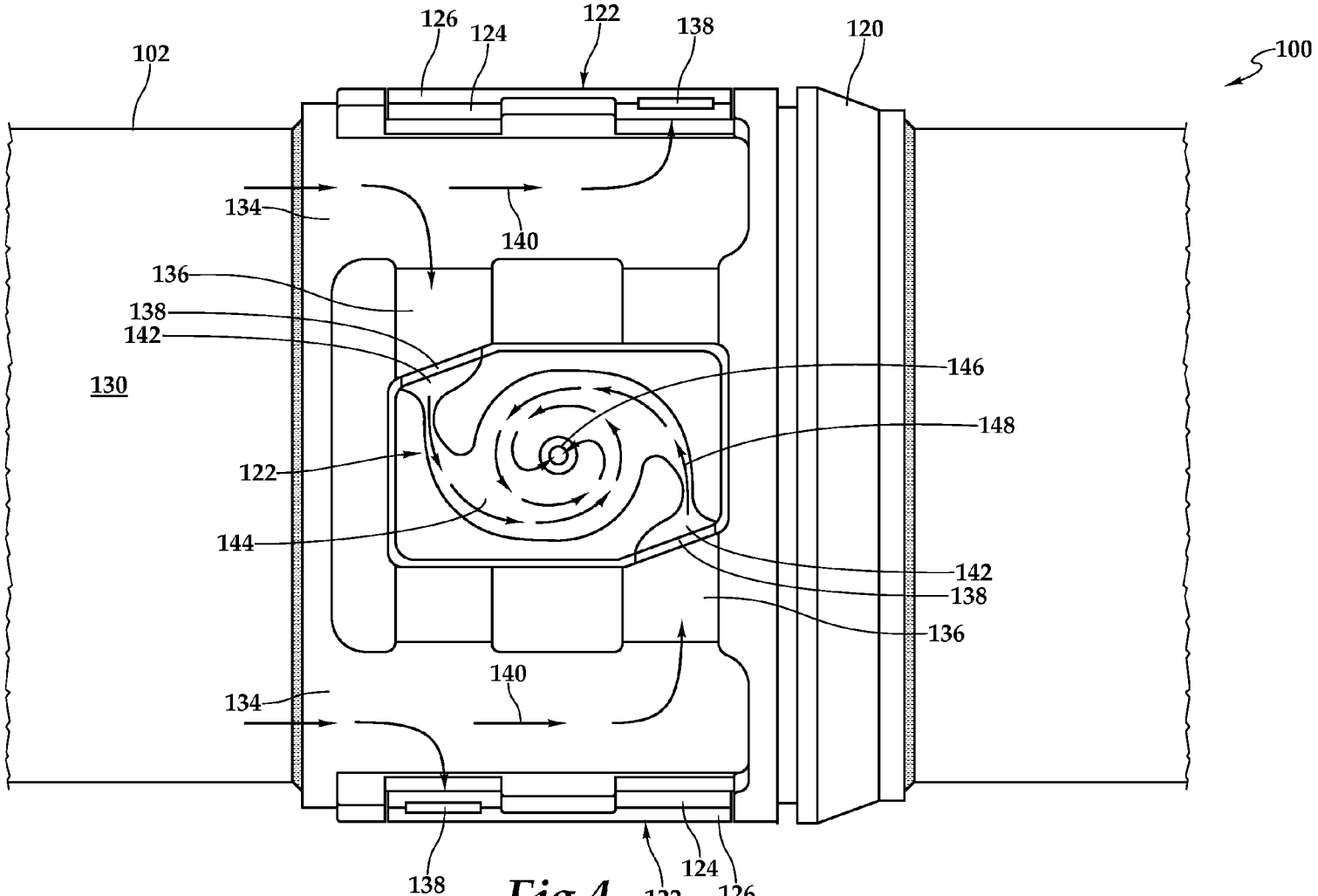
FIG. 4 is a top view of the flow control section of a downhole fluid flow control system according to an embodiment of the present invention with the outer housing and an outer element of a flow control component removed depicting a production operation.

Referring next to FIG. 4, a flow control section of fluid flow control system 100 is representatively illustrated during a production phase of well operations. In the illustrated example, production flow is depicted as arrows 140 that are entering openings 138 of flow control components 122 from annular region 130 via longitudinal channels 134 and circumferential channels 136. In the production scenario, flow control components 122 have a pair of inlets 142, a vortex chamber 144 and an outlet 146. Each of the inlets 142 directs fluid into vortex chamber 144 primarily in a tangentially direction. Fluids entering vortex chamber 144 primarily tangentially will spiral around vortex chamber 144, as indicted by arrow 148, before eventually flowing through outlet 146. Fluid spiraling around vortex chamber 144 will suffer from frictional losses. Further, the tangential velocity produces centrifugal force that impedes radial flow. Consequently, production fluids passing through flow control components 122 that enter vortex chamber 144 primarily tangentially encounter significant resistance. This resistance is realized as back-pressure on the upstream production fluids which results in a reduction in flowrate. This type of inflow control is beneficial in balancing the production from the various production intervals, as best seen in FIG. 1, which, for example, counteracts heel-toe effects in long horizontal completions, balances inflow in highly deviated and fractured wells and reduces water/gas influx, thereby lengthening the productive life of the well.

Even though a particular design of inlets 142, vortex chamber 144 and outlet 146 has been depicted and described, those skilled in the art will recognize that the design of the fluid flow resisting elements within flow control components 122 will be determined based upon factors such as the desired flowrate, the desired pressure drop, the type and composition of the production fluids and the like. For example, when the fluid flow resisting element within a flow control component is a vortex chamber, the relative size, number and approach angle of the inlets can be altered to direct fluids into the vortex chamber to increase or decrease the spiral effects, thereby increasing or decreasing the resistance to flow and providing a desired flow pattern in the vortex chamber. In addition, the vortex chamber can include flow vanes or other directional devices, such as grooves, ridges, waves or other surface shaping, to direct fluid flow within the chamber or to provide different or additional flow resistance. It should be noted by those skilled in the art that even though the vortex chambers can be cylindrical, as shown, flow control components of the present invention could have vortex chambers having alternate shapes including, but not limited to, right rectangular, oval, spherical, spheroid and the like.

Figure 5:
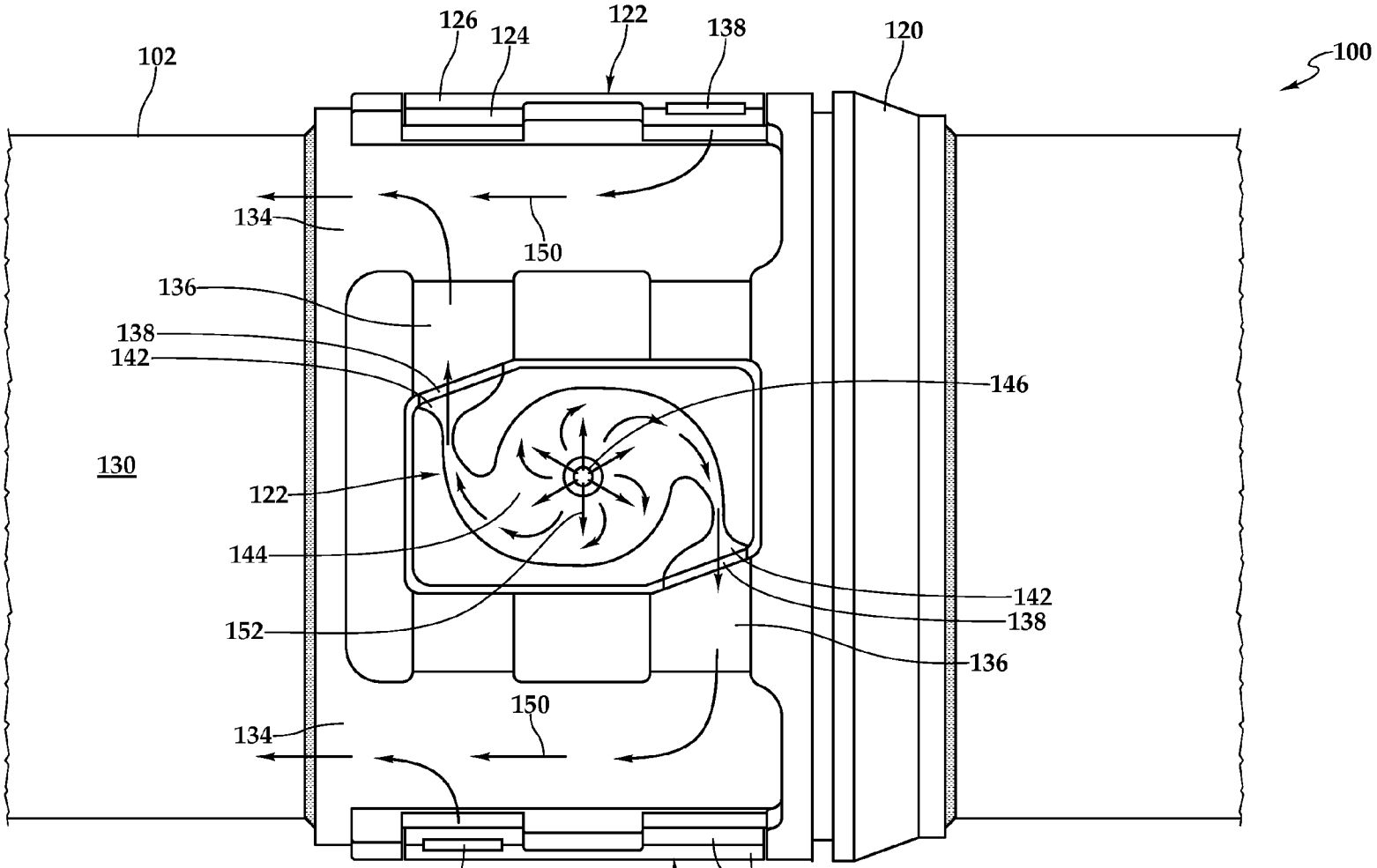
FIG. 5 is a top view of the flow control section of a downhole fluid flow control system according to an embodiment of the present invention with the outer housing and an outer element of a flow control component removed depicting an injection operation.

Referring next to FIG. 5, a flow control section of fluid flow control system 100 is representatively illustrated during a treatment phase of well operations. In the illustrated example, treatment fluid flow is depicted as arrows 150 that are exiting openings 138 of flow control components 122 and entering annular region 130 via longitudinal channels 134 and circumferential channels 136. In the injection scenario, flow control components 122 have a pair of outlets 142, a vortex chamber 144 and an inlet 146. Injection fluids entering vortex chamber 144 from inlet 146 primarily travel in a radial direction within vortex chamber 144, as indicted by arrows 152, before flowing through outlets 142 with little spiraling within vortex chamber 144 and without experiencing the associated frictional and centrifugal losses. Consequently, injection fluids passing through flow control components 122 that enter vortex chamber 144 primarily radially encounter little resistance and pass therethrough relatively unimpeded enabling a much higher flowrate with significantly less pressure drop than in the production scenario described above. This type of outflow control is beneficial during, for example, an acid stimulation treatment that requires a high injection rate of the treatment fluid at a treatment pressure near but below the fracture pressure of the formation.

As illustrated in FIGS. 4 and 5, use of flow control components 122 in a flow control section of fluid flow control system 100 enables both production fluid flow control and injection fluid flow control. In the illustrated examples, flow control components 122 provide a greater resistance to flow during a production phase of well operations as compared to a treatment phase of well operations. Unlike complicated and expensive prior art systems that required one set of flow control components for production and another set flow control components for injection along with the associated check valves to prevent reverse flow, the present invention is able to achieve the desired flow and pressure regimes for both the production direction and the injection direction utilizing a single set of flow control components operable for bidirectional flow with direction dependent flow resistance. In this manner, use of the flow control components of the present invention in fluid flow control systems including flow control screens enables improved bidirectional flow control.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole fluid flow control method comprising:

positioning a fluid flow control system having a flow control component with a vortex chamber having direction dependent flow resistance at a target location downhole;

pumping a treatment fluid from the surface into a formation through the flow control component in a first direction such that the treatment fluid experiences a first pressure drop; and producing a formation fluid to the surface through the flow control component in a second direction such that the formation fluid experiences a second pressure drop, wherein the first pressure drop is different from the second pressure drop, and wherein formation fluid directly enters the vortex chamber through at least a pair of oppositely disposed inlets that direct the formation fluid in at least two tangential directions of the vortex chamber.

2. The method as recited in claim 1 wherein pumping a treatment fluid from the surface into a formation through the flow control component in a first direction such that the treatment fluid experiences a first pressure drop further comprises pumping the treatment fluid into the vortex chamber such that the treatment fluid entering the vortex chamber travels primarily in a radial direction.

3. The method as recited in claim 1 wherein the first pressure drop is less than the second pressure drop.

4. A downhole fluid flow control method comprising:

positioning a flow control screen at a target location downhole, the flow control screen having a base pipe with an internal passageway, a blank pipe section and a perforated section, a filter medium positioned around the blank pipe section of the base pipe, a housing positioned around the base pipe defining a fluid flow path between the filter medium and the internal passageway and a flow control component with a vortex chamber having direction dependent flow resistance disposed within the fluid flow path;

pumping a treatment fluid from the surface into a formation through the flow control component in a first direction such that the treatment fluid experiences a first pressure drop; and producing a formation fluid to the surface through the flow control component in a second direction such that the formation fluid experiences a second pressure drop, wherein the first pressure drop is different from the second pressure drop, and wherein formation fluid directly enters the vortex chamber through at least a pair of oppositely disposed inlets that direct the formation fluid in at least two tangential directions of the vortex chamber.

5. The method as recited in claim 4 wherein pumping a treatment fluid from the surface into a formation through the flow control component in a first direction such that the treatment fluid experiences a first pressure drop further comprises pumping the treatment fluid into the vortex chamber such that the treatment fluid entering the vortex chamber travels primarily in a radial direction.

6. The method as recited in claim 4 wherein the first pressure drop is less than the second pressure drop.

7. A downhole fluid flow control method for balancing production from a plurality of production zones that are isolated from one another, the method comprising:

positioning at least one flow control screen in each of the plurality of production zones, each of the flow control screens having a base pipe with an internal passageway, a blank pipe section and a perforated section, a filter medium positioned around the blank pipe section of the base pipe, a housing positioned around the base pipe defining a fluid flow path between the filter medium and the internal passageway and a flow control component with a vortex chamber having direction dependent flow resistance disposed within the fluid flow path;

pumping treatment fluid from the surface into the production zones through the flow control components in a first direction such that the treatment fluid experiences a first pressure drop; and producing formation fluid from the production zones to the surface through the flow control components in a second direction such that the formation fluid experiences a second pressure drop, wherein the first pressure drop is different from the second pressure drop, and wherein formation fluid directly enters the vortex chambers through at least a pair of oppositely disposed inlets that direct the formation fluid in at least two tangential directions of the vortex chambers, thereby balancing production from the plurality of production zones.

8. The method as recited in claim 7 wherein the first pressure drop is less than the second pressure drop.

* * * * *